US012084885B2

(12) United States Patent
Besnier et al.

(10) Patent No.: US 12,084,885 B2
(45) Date of Patent: Sep. 10, 2024

(54) CONSTRUCTIONS OF AUTOMATIC SWIMMING POOL CLEANERS

(71) Applicant: ZODIAC POOL CARE EUROPE, Belberaud (FR)

(72) Inventors: Arnaud Besnier, Beaupuy (FR); Louis Favie, Colomiers (FR); Pierre Mazet, Saint Orens de Gameville (FR); Remi Deloche, Toulouse (FR)

(73) Assignee: ZODIAC POOL CARE EUROPE, Belberaud (FR)

( * ) Notice: Subject to any disclaimer, the term of this patent is extended or adjusted under 35 U.S.C. 154(b) by 0 days.

(21) Appl. No.: 17/512,846

(22) Filed: Oct. 28, 2021

(65) Prior Publication Data

US 2022/0136271 A1 May 5, 2022

Related U.S. Application Data

(60) Provisional application No. 63/107,318, filed on Oct. 29, 2020.

(51) Int. Cl.
*E04H 4/16* (2006.01)

(52) U.S. Cl.
CPC ..... *E04H 4/1654* (2013.01)

(58) Field of Classification Search
CPC ..... E04H 4/1654; E04H 4/16; A47L 11/40; A47L 2201/00
USPC ..... 15/21.1, 1.7
See application file for complete search history.

(56) References Cited

U.S. PATENT DOCUMENTS

| | | | | |
|---|---|---|---|---|
| 9,611,668 | B2 | 4/2017 | Van Der Meijden et al. | |
| 10,407,931 | B2 | 9/2019 | Zerweck et al. | |
| 2014/0137891 | A1 | 5/2014 | Hanan et al. | |
| 2014/0259464 | A1* | 9/2014 | Renaud | B60B 37/10 29/428 |
| 2018/0328062 | A1* | 11/2018 | Ortiz | E04H 4/1654 |
| 2019/0085580 | A1* | 3/2019 | Ellis | E04H 4/1636 |

OTHER PUBLICATIONS

International Application No. PCT/IB2021/059987, Invitation to Pay Additional Fees and, Where Applicable, Protest Fee mailed on Jan. 26, 2022, 9 pages.
International Application No. PCT/IB2021/059987, International Preliminary Report on Patentability mailed on May 11, 2023, 9 pages.
International Application No. PCT/IB2021/059987, International Search Report and Written Opinion mailed on Mar. 21, 2022, 14 pages.

* cited by examiner

*Primary Examiner* — Abbie E Quann
(74) *Attorney, Agent, or Firm* — Kilpatrick Townsend & Stockton LLP

(57) ABSTRACT

Automatic swimming pool cleaners (APCs) may include separate chassis and bodies. Such constructions may facilitate assembly and disassembly of certain components of the APCs, with or without using tools. APCs with separate chassis and bodies may enable quick and easy access to motor assemblies of the APC, and bodies of the APCs may be readily interchanged on a common chassis.

12 Claims, 11 Drawing Sheets

CONSTRUCTIONS OF AUTOMATIC SWIMMING POOL CLEANERS

REFERENCE TO RELATED APPLICATION

This application claims the benefit of U.S. Provisional Application No. 63/107,318, filed on Oct. 29, 2020, and entitled CONSTRUCTIONS OF AUTOMATIC SWIMMING POOL CLEANERS, the content of which is hereby incorporated by reference in its entirety.

FIELD OF THE INVENTION

This application relates to cleaning devices for water-containing vessels such as swimming pools and spas, and more particularly, although not necessarily exclusively, to constructions of autonomous swimming pool cleaners and manners in which they may be assembled and disassembled.

BACKGROUND

Automatic swimming pool cleaners (APCs) are well known. These cleaners often are categorized as either "hydraulic" or "robotic" (or "electric"), depending on the source of their motive power. Hydraulic cleaners, for example, typically use pressurized (or depressurized) water to affect their autonomous movement within pools, whereas robotic cleaners typically utilize an electric motor to cause their movement. Moreover, hydraulic cleaners frequently are subcategorized as either "pressure-side" or "suction-side" devices, with pressure-side cleaners receiving pressurized water output from an associated water-circulation pump and suction-side cleaners, by contrast, being connected to an inlet of the pump.

One of numerous types of APCs is described in U.S. Patent Application Publication No. 2014/0137891 of Hanan, et al., whose entire contents are incorporated herein by this reference. Disclosed in the Hanan application is an "electric" cleaner having a motor as well as front and back wheels. At least the wheels support a "chassis or bottom body." A "bridge" to which the electric motor is mounted forms the top section of the body. No mechanism is detailed in the Hanan application for attaching the bridge to the chassis, and no description exists of moving the bridge relative to the chassis or of detaching the bridge from the chassis.

U.S. Pat. No. 9,611,668 to van der Meijden, et al, whose entire contents also are incorporated herein by reference, illustrates another exemplary APC. As discussed in the van der Meijden patent, the APC may be a suction-side hydraulic cleaner having a body and a motive assembly. The body includes an upper section and a lower section, with the upper section preferably pivoting relative to the lower section so as to expose an interior region of the body. Hinges are described as allowing such pivoting, although the van der Meijden patent contains no express discussion of detaching the two sections.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments, an automatic swimming pool cleaner includes a chassis and a housing that may to detach from the chassis without using tools.

According to some embodiments, an automatic swimming pool cleaner includes a common chassis and interchangeable housings that are attachable to and detachable from the common chassis.

According to various embodiments, an automatic swimming pool cleaner includes a chassis, a motor assembly having at least a portion contained in the chassis, and a housing that is attachable to the chassis. The housing may include a lid that is movable between a closed position and an open position providing access to the motor assembly.

According to certain embodiments, an automatic swimming pool cleaner includes a chassis and a housing, and one of the chassis or the housing includes teeth or ribs, and the other includes recesses for receiving the teeth or ribs.

According to various embodiments, an automatic swimming pool cleaner includes a chassis, a housing, a motor block positioned at least partially in the chassis, and a flow outlet configured to attach to the motor block in a manner sandwiching or at least partially retaining the housing between them.

According to some embodiments, a method of disassembling an automatic swimming pool cleaner having a chassis, a housing, and a flow outlet includes (i) opening a lid of the housing to expose the flow outlet, (ii) detaching the flow outlet from a motor assembly, and (iii) rotating the housing so as to disengage the housing from the chassis. In other embodiments, the housing need not rotate to disengage the housing from the chassis.

According to certain embodiments, an automatic swimming pool cleaner includes a housing and a chassis, and the housing is removably attached to the chassis.

According to some embodiments, an automatic swimming pool cleaner includes a chassis, a housing, a motor block positioned at least partially in the chassis, and a flow outlet. The flow outlet is attachable to the motor block such that at least a portion of the housing is retained between the motor block and the flow outlet.

According to certain embodiments, an automatic swimming pool cleaner includes a chassis with a chassis cavity, a housing with a housing cavity, and a motor assembly positioned at least partially in the chassis cavity and extending at least partially into the housing cavity.

Various implementations described in the present disclosure can include additional systems, methods, features, and advantages, which can not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

Figure 1:
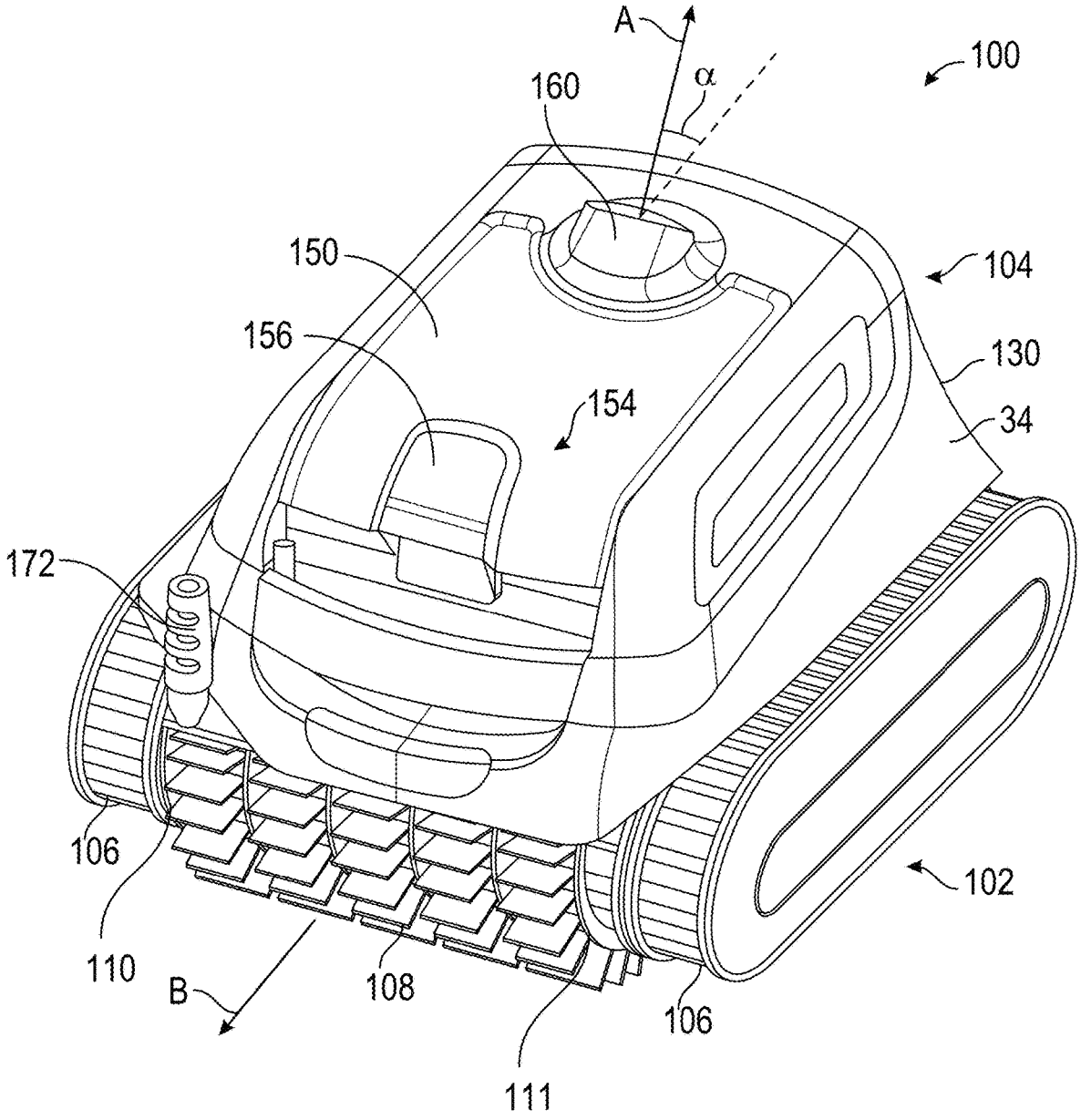
FIG. 1 illustrates an APC with a chassis and a body according to embodiments, and with a lid of the APC in a closed position.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "up," "down," "top," "bottom," "left," "right," "front," and "back," among others, are intended to refer to the orientation as illustrated and described in the figure (or figures) to which the components and directions are referencing. References to "pools" and "swimming pools" herein may also refer to spas or other water containing vessels or structures used for recreation or therapy.

Described herein are assemblies of autonomous vehicles such as APCs. In certain embodiments, the assemblies described herein may permit components of the APCs to be assembled and disassembled when desired and without requiring tools. In certain embodiments, a body of the APC includes a connecting mechanism that is complementary to a connecting mechanism on a chassis of the APC such that the body can be selectively attached to or detached from the chassis as desired. In some embodiments, the body of the APC may assemble (and allow disassembly of) one or more sub-assemblies with the chassis of the APC without requiring tools. Stated differently, the assemblies described herein may permit various sub-systems or sub-assemblies of the APC to be selectively held together without requiting tools.

In various embodiments, the assemblies described herein may enable customization of the APC such that a plurality of different bodies can be selectively assembled on a common chassis or vice versa, and/or such that a plurality of different sub-assemblies and/or sub-systems can be selectively assembled on a common chassis or vice versa. In some embodiments, the assemblies described herein may provide improved access to components within the APC, including but not limited to a motor block, a battery block, an electronics housing, a filter housing, etc., without requiring disassembly of the APC. In certain aspects, assemblies with a common chassis and/or a common body may reduce the time needed for production and/or maintenance of the APC. As a non-limiting example, a body in need of maintenance may be removed from a chassis, and a replacement body may be installed on the same chassis while the previously installed body is being serviced. Various other benefits and advantages may be realized with the assemblies described herein, and the aforementioned benefits should not be considered limiting.

FIGS. 1-10 illustrate an APC 100 according to various embodiments. In the embodiment illustrated, the APC 100 is an electric cleaner, although in other embodiments, the APC 100 may be a hydraulic cleaner or other suitable cleaner as desired. The principles of the present invention may apply to other structures as well, and are not necessarily limited to autonomous vehicles for swimming pools.

The APC 100 generally includes a chassis 102 and a housing 104. In use, and as illustrated in FIG. 1, the housing 104 and the chassis 102 are assembled together. As discussed in detail below, the housing 104 is removably attached to the chassis 102 such that the housing 104 may be selectively (and repeatedly) attached to or detached from the chassis 102 as desired, promoting facile disassembly of these components.

In certain embodiments, the APC 100 optionally includes one or more motive elements 106 for moving the APC 100 within a particular environment, including but not limited to a swimming pool. In the embodiment illustrated, the motive elements 106 are tracks that are supported on the chassis 102; however, in other embodiments, the motive elements 106 may be various suitable devices, mechanisms, or combinations of devices and mechanisms suitable for moving the APC 100, and they need not be supported on the chassis 102. As some non-limiting examples, other suitable types of motive elements 106 may include wheels, rollers, feet, and/or other devices or mechanisms as desired.

The APC 100 may be powered in any suitable manner. In one non-limiting example, on-board batteries are not employed, and external electrical power may be routed into chassis 102 via a connector 172 and/or otherwise as desired. No management of electrical cables hence need occur in housing 104 in such an embodiment. In other embodiments, the connector 172 may be omitted, and the APC 100 may include batteries and/or otherwise be powered as desired.

The APC 100 may include various optional and/or additional features as desired, including but not limited to cleaning devices (e.g., brushes, scrapers, vacuum nozzles, etc.), lights, sensors, handles, filters, etc. as desired and/or depending on the particular type of APC 100. In the embodiment illustrated, the APC 100 includes an optional scrubbing brush 108 supported on the chassis 102 and that may be used during a cleaning operation of the APC 100. In other embodiments, other types of cleaning devices may be utilized and/or may be omitted as desired. As such, the features illustrated with the APC 100 should not be considered limiting.

Figure 7B:
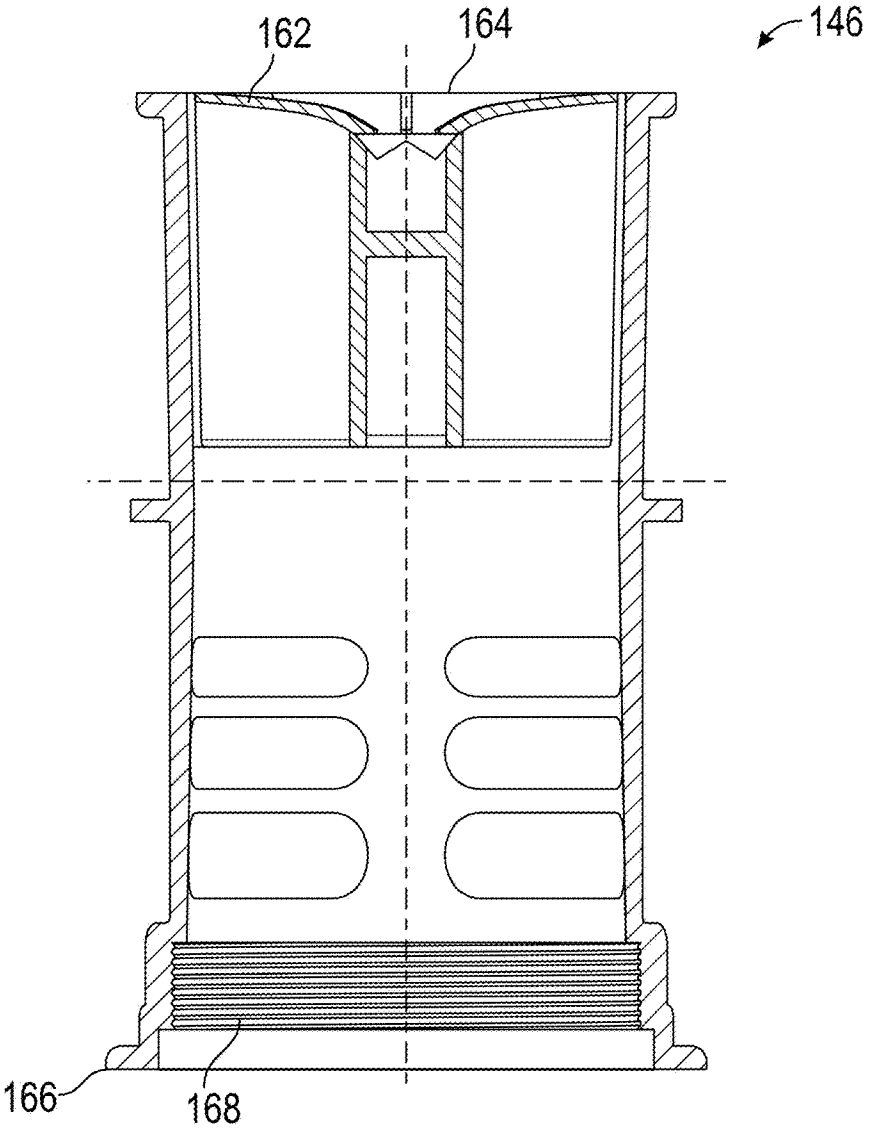
FIGS. 7A-B illustrate the flow outlet of the APC of FIG. 1 according to embodiments.
Figure 7A:
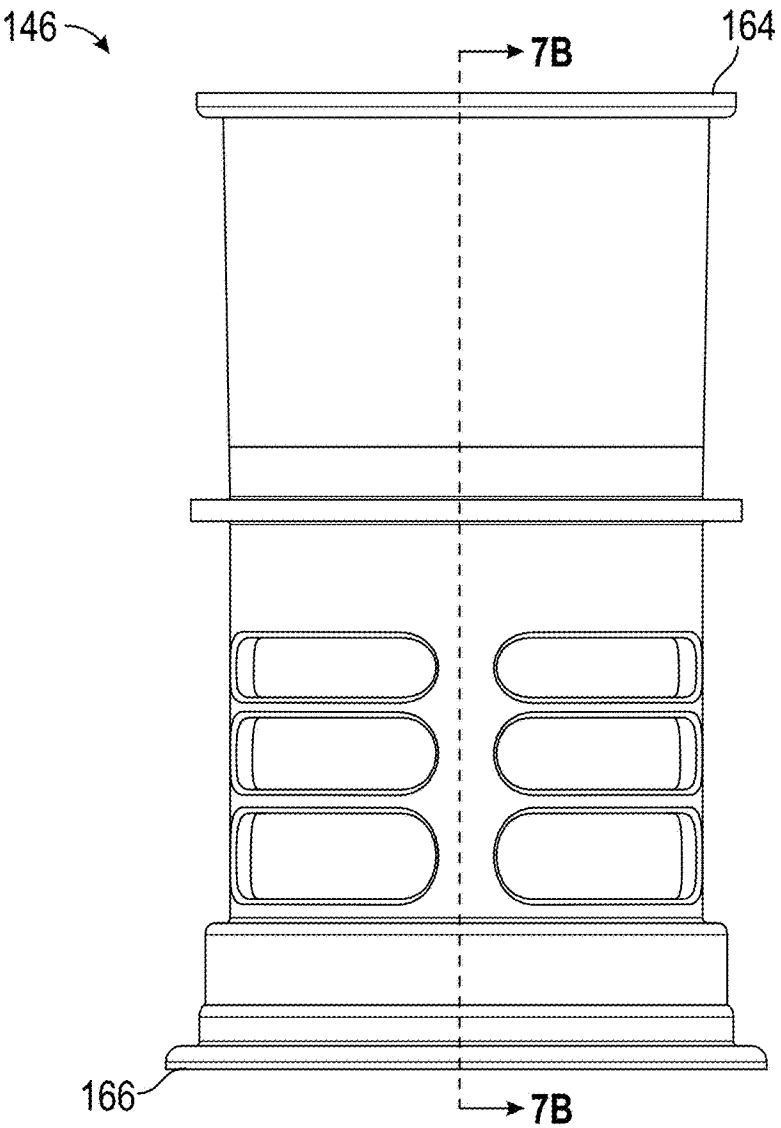
Figure 8:
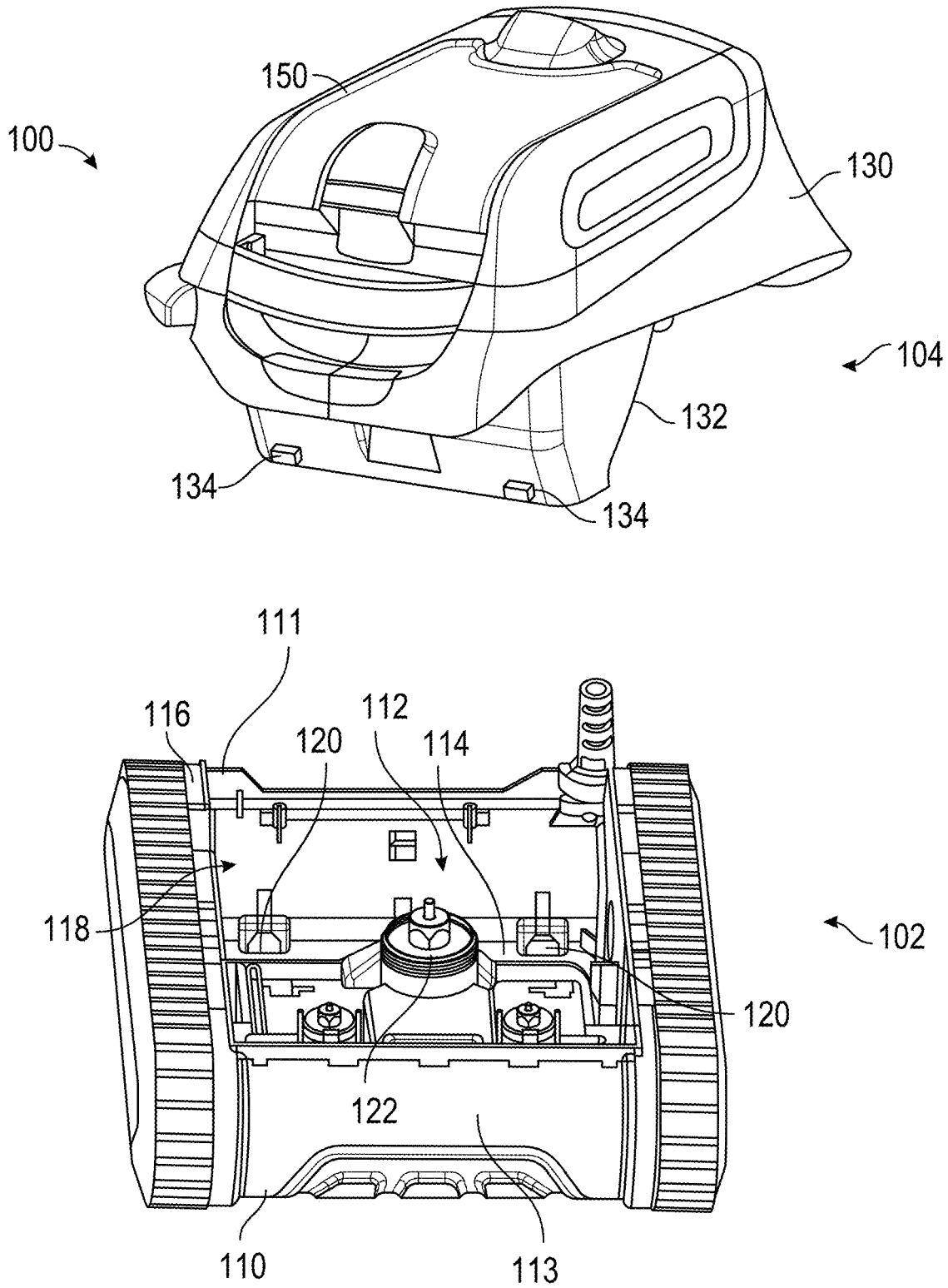
FIG. 8 is another view of the APC of FIG. 1 illustrating the body detached from the chassis.
Figure 9:
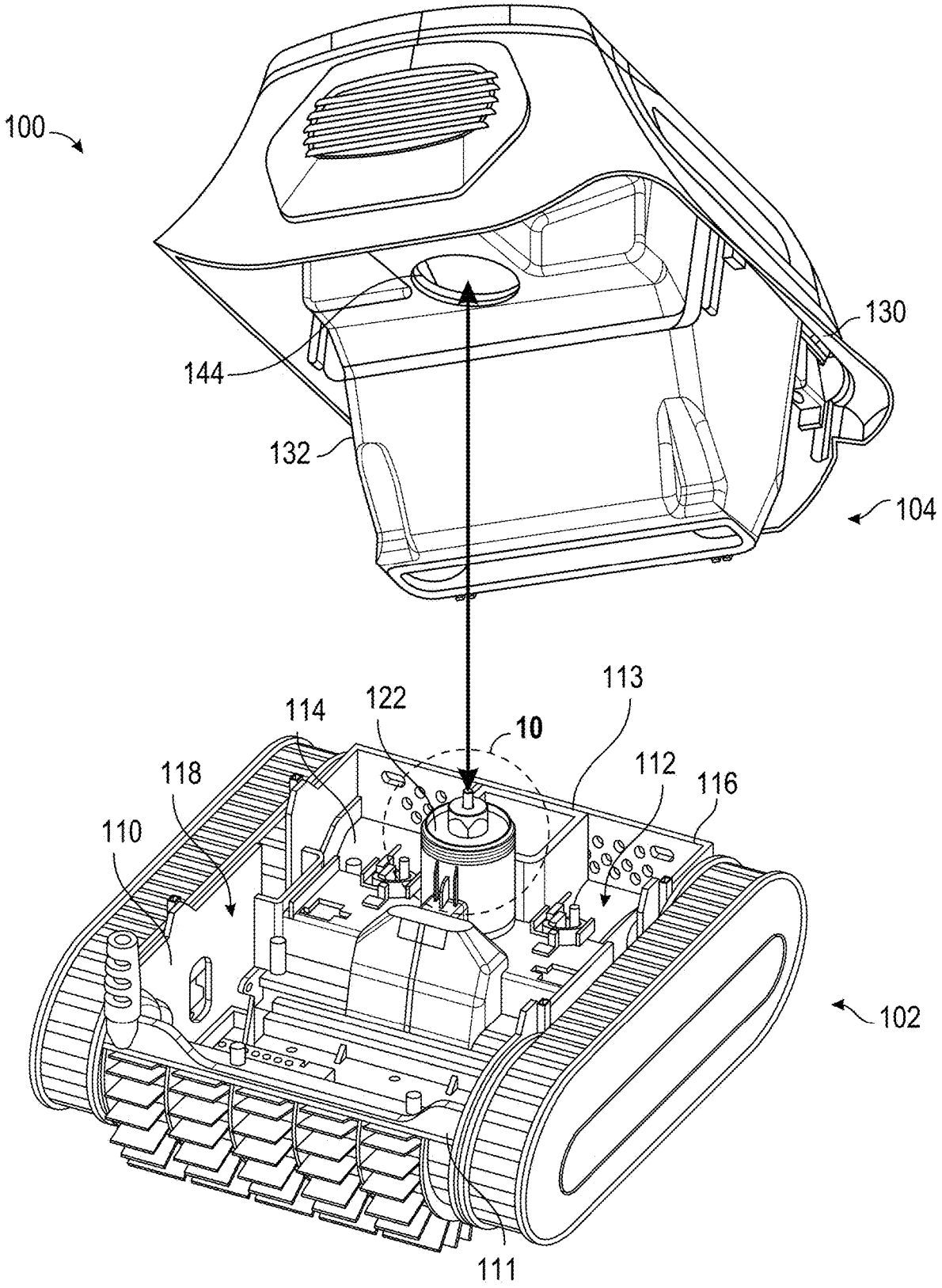
FIG. 9 is another view of the APC of FIG. 1 illustrating the body detached from the chassis.

As best illustrated in FIGS. 5, 6, 8, and 9, the chassis 102 of the APC 100 generally includes a body 110 for supporting one or more components of the APC 100. The body 110 includes a first (e.g., front) end 111 and a second (e.g., back) end 113, although the particular end that is the "front" or the "back" may depend on the direction of movement of the APC 100. As mentioned, in the embodiment illustrated, the body 110 supports the motive elements 106 and the brush 108. The body 110 also defines a chassis cavity 112 for receiving and/or supporting one or more components of the APC 100. In the embodiment illustrated and as discussed in detail below, a motor assembly and a portion of the housing 104 are each at least partially positioned within the chassis cavity 112. The chassis cavity 112 includes a bottom surface 114 that is recessed relative to a top end 116 of the body 110. As best illustrated in FIGS. 8 and 9, the body 110 defines an opening 118 to the chassis cavity 112. In some embodiments, the opening 118 is defined at the top end 116, although it need not be in other embodiments. The particular shape and size of the chassis cavity 112 and the opening 118 illustrated in FIGS. 1-10 should not be considered limiting.

In certain embodiments, and as best illustrated in FIG. 8, the chassis 102 includes one or more engagement features 120 for selectively engaging the housing 104 and such that the housing 104 is attachable to and detachable from the chassis 102 as desired. In the embodiment illustrated, the chassis 102 includes two engagement features 120, although any desired number of engagement features 120 may be used in other embodiments. Moreover, while the engagement features 120 are illustrated within the chassis cavity 112 and between the bottom surface 114 and the top end 116, in other embodiments, the engagement features 120 may be provided at various locations as desired. In the embodiment illustrated, the engagement features 120 are grooves or recesses defined in the body 110 and that selectively receive engagement features 134 on the housing 104 that are teeth or ribs. In other embodiments, the engagement features 120 may be the teeth or ribs and the engagement features 134 on the housing 104 may be the grooves or recesses. Moreover, in other embodiments, other types of engagement features that are selectively engageable may be utilized on the chassis 102 and/or the housing 104 as desired. As some non-limiting examples, the engagement features on the chassis 102 and/or the housing 104 may be ribs that engage each other, snap-fit engagement features, biasing members, clips, combinations thereof, and/or various other features, devices, or mechanisms as desired.

Figure 10:
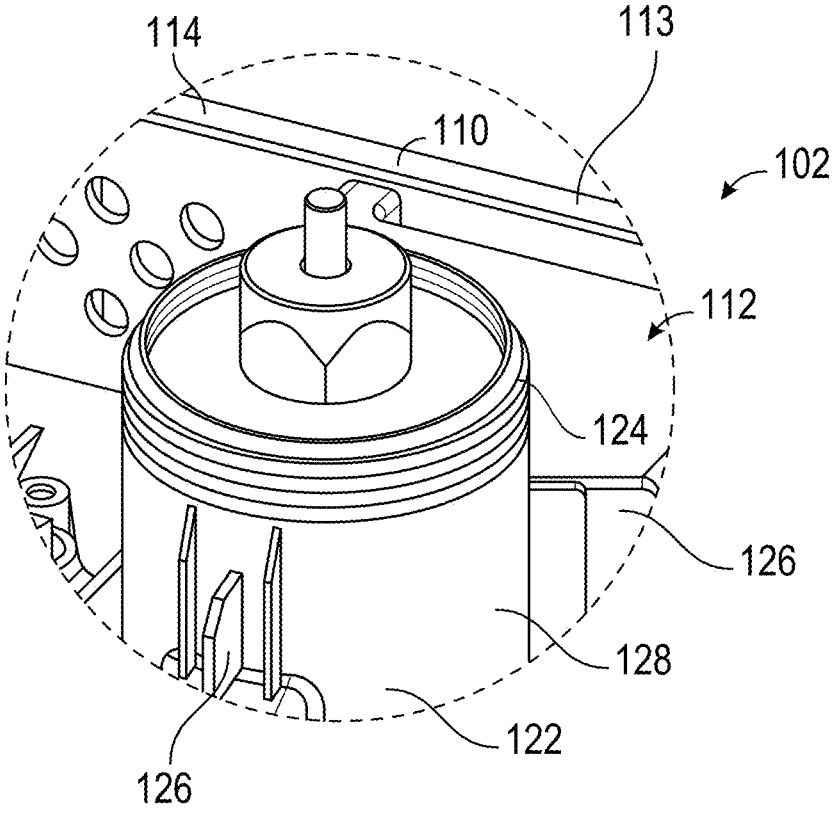
FIG. 10 illustrates a portion of the APC taken from circle 10 in FIG. 9.

As mentioned, one or more components of the APC 100 may be at least partially positioned within the chassis cavity 112, including but not limited to a motor block, battery block, electronics housing, filter housing, combinations thereof, and/or other components of the APC 100 as desired. As best illustrated in FIGS. 6, 8, 9, and 10, in the embodiment illustrated, the APC 100 includes a motor assembly such as a motor block 122 located at least partially within the chassis cavity 112. Referring to FIG. 10, in certain embodiments, the motor block 122 optionally includes engagement features 124 for selectively engaging a flow outlet 146 and/or one or more stoppers 126. While the engagement features 124 and stoppers 126 are illustrated on the motor block 122, they need not be in other embodiments, and other components within the chassis cavity 112 and/or the chassis 102 itself may selectively engage the flow outlet 146. As a non-limiting example, a portion of the chassis 102 may include the engagement features 124 for selectively engaging the flow outlet 146. As another non-limiting example, a portion of the chassis 102 may include the one or more stoppers 126 for selectively supporting the housing 104 as the housing 104 is positioned into engagement with the chassis 102. As such, while the following description will make reference to the motor block 122, the features described herein may be included with other components within the chassis 102 and/or the chassis 102 itself.

In the embodiment illustrated, the engagement features 124 are threads for engaging corresponding threads on the flow outlet 146, although in other embodiments, other types of mechanisms or devices may be used as the engagement features 124 and/or the engagement features 168 on the flow outlet 146. As some non-limiting examples, the engagement features on the flow outlet 146, chassis 102, motor block 122, etc. may be hooks, clips, snap rings, inserts, snap-fit engagement features, quarter turn solutions with or without angular positioning, combinations thereof, and/or various other features, mechanisms, or devices as desired.

When included, the one or more stoppers 126 may extend outwards from an exterior surface 128 of the motor block 122. The stoppers 126 may be spaced uniformly or irregularly, and the number of stoppers 126 and/or shape or profile of the stoppers 126 should not be considered limiting. In the embodiment illustrated, the motor block 122 includes three stoppers 126 that are spaced evenly on the exterior surface 128. The stoppers 126, if present, may support the housing 104 as the housing 104 is positioned into engagement with the chassis 102. Optionally, and as discussed in detail below, a portion of the housing 104 may be sandwiched or positioned between one or more stoppers 126 and the flow outlet 146 to connect the housing 104 to the chassis 102. While the stoppers 126 are illustrated with the motor block 122, in other embodiments, one or more stoppers additionally or alternatively may be provided at other locations on the chassis 102, including within the chassis cavity 112, for selectively contacting and supporting the housing 104 as the housing 104 is moved into engagement with the chassis 102.

The housing 104 of the APC 100 includes a body 130 and is removably attached to the chassis 102. Similar to the chassis 102, the particular shape and size of the housing 104 illustrated in FIGS. 1-10 should not be considered limiting.

In certain embodiments, and as best illustrated in FIGS. 8 and 9, the housing 104 optionally includes an engagement section 132 that extends downwardly from the body 130 and that is positionable at least partially within the chassis cavity 112. The particular shape and size of the engagement section 132 should not be considered limiting. In some embodiments, the engagement section 132 positioned within the chassis cavity 112 may orient the housing 104 relative to the chassis 102. As best illustrated in FIG. 8, one or more engagement features 134 optionally may be provided on the engagement section 132 for selectively engaging the engagement features 120 of the chassis 102, thereby facilitating connection of the housing 104 to the chassis 102 for use of APC 100. In the embodiment illustrated, the engagement features 134 are teeth or ribs; however, as mentioned, in other embodiments, the engagement features 134 may be various suitable features or mechanisms for selectively engaging the engagement features 120 to removably attach the housing 104 to the chassis 102. Moreover, while the engagement features 134 are illustrated on the engagement section 132 of the housing 104, in other embodiments, one or more engagement features 134 may be provided at various other locations as desired. In certain aspects, the engagement of the engagement features 120, 134 within the chassis cavity 112 may minimize inadvertent detachment of the housing 104 from the chassis 102. As a non-limiting example, the engagement features 120, 134 engaged within the chassis cavity 112 may provide an improved attachment that is maintained even if the APC 100 runs into a wall during a cleaning operation.

Figure 2:
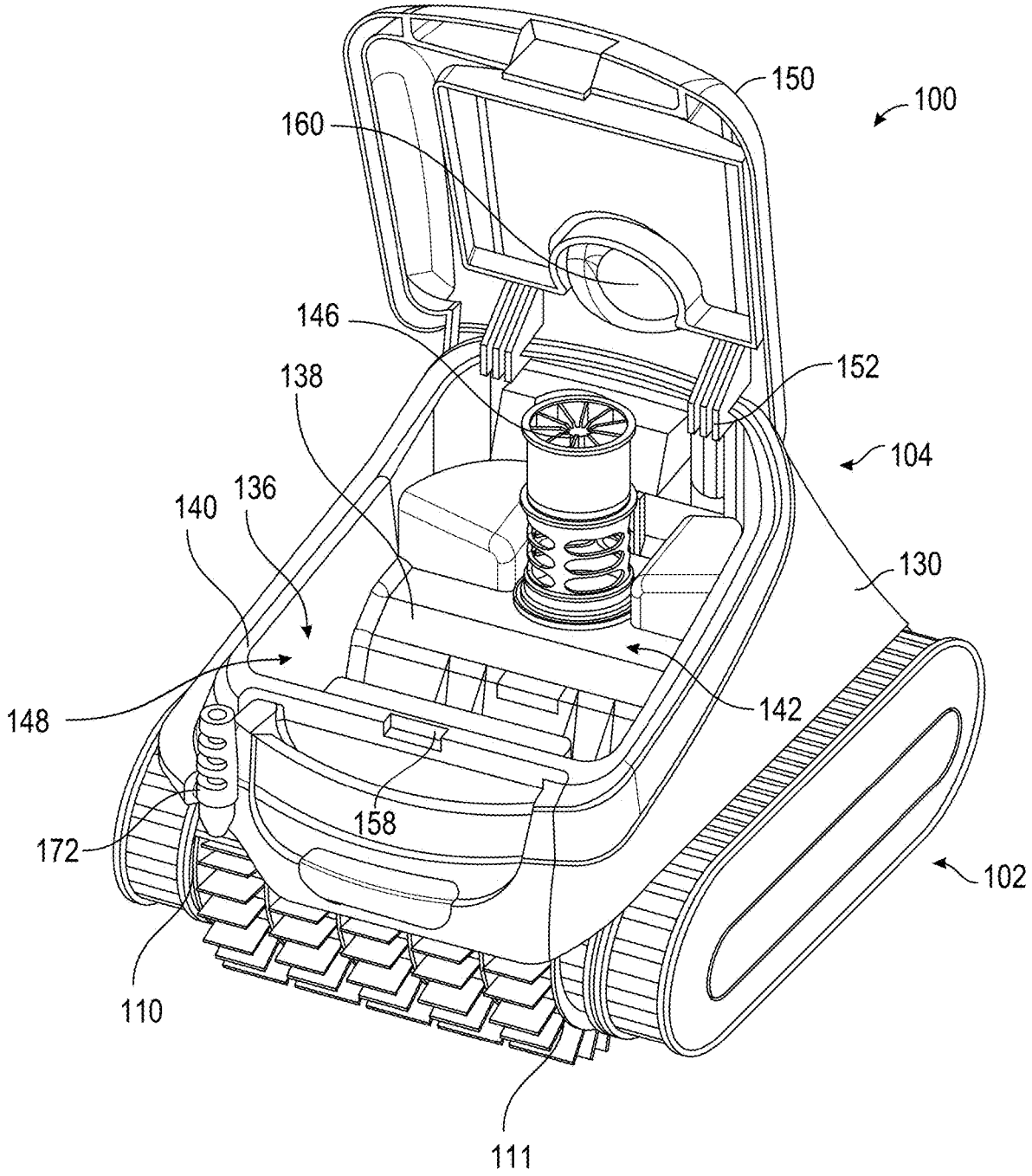
FIG. 2 illustrates the APC of FIG. 1 with a lid of the APC in an open position.
Figure 3:
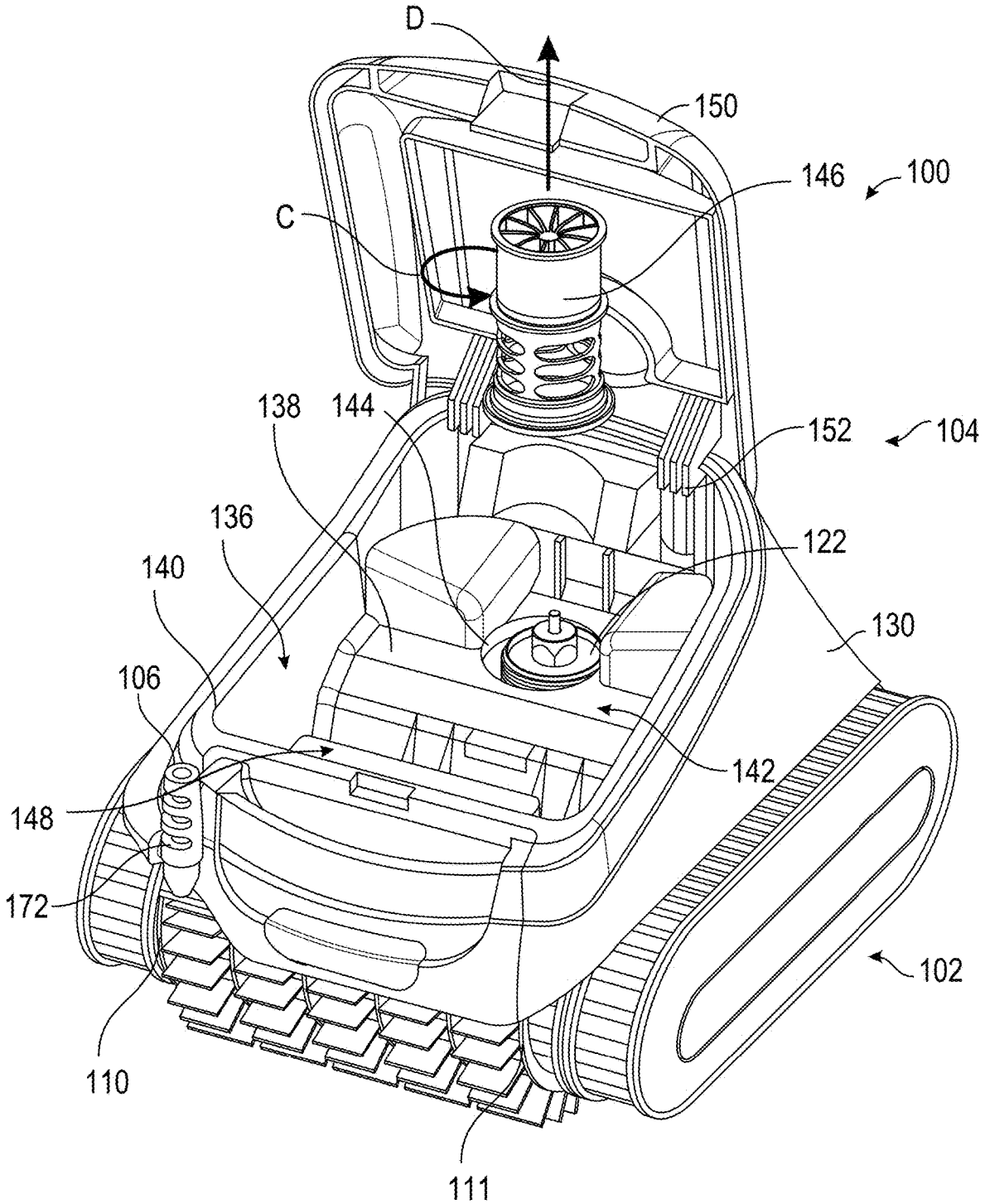
FIG. 3 illustrates the APC of FIG. 1 with allow outlet detached from the APC.
Figure 4:
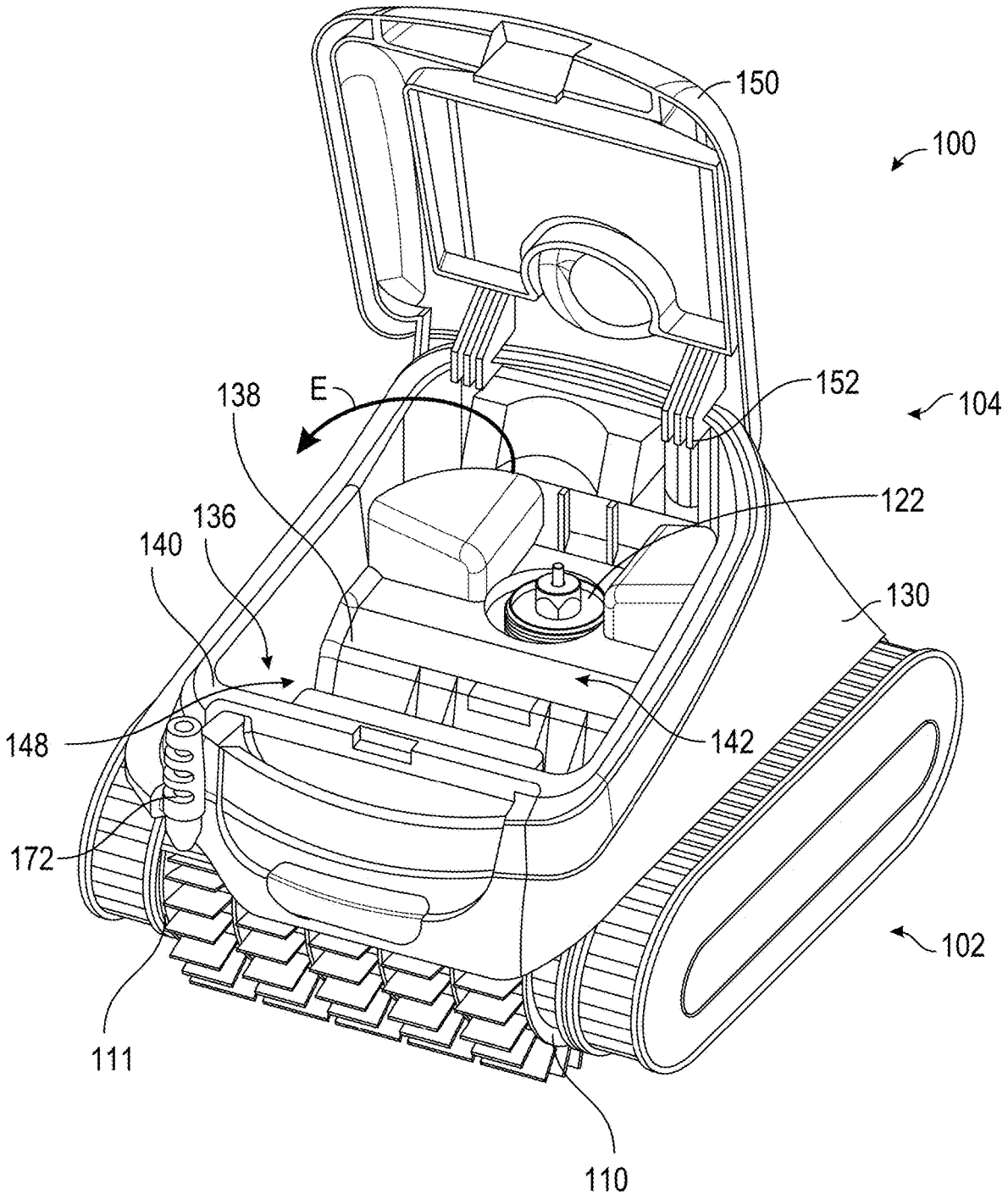
FIG. 4 illustrates the APC of FIG. 1 with the body partially rotated relative to the chassis and partially disengaged from the chassis.
Figure 5:
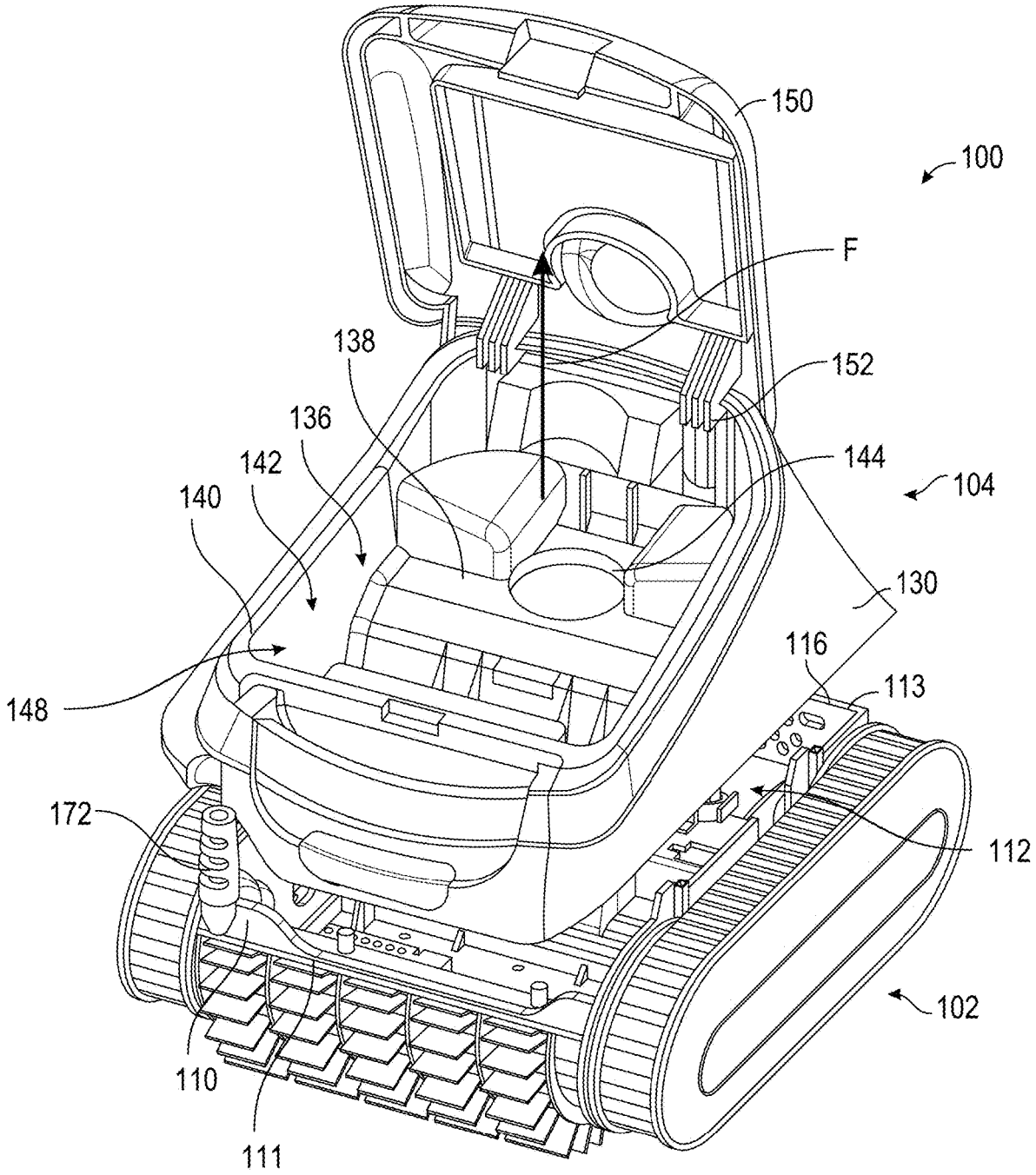
FIG. 5 illustrates the APC of FIG. 1 with the body detached from the chassis.
Figure 6:
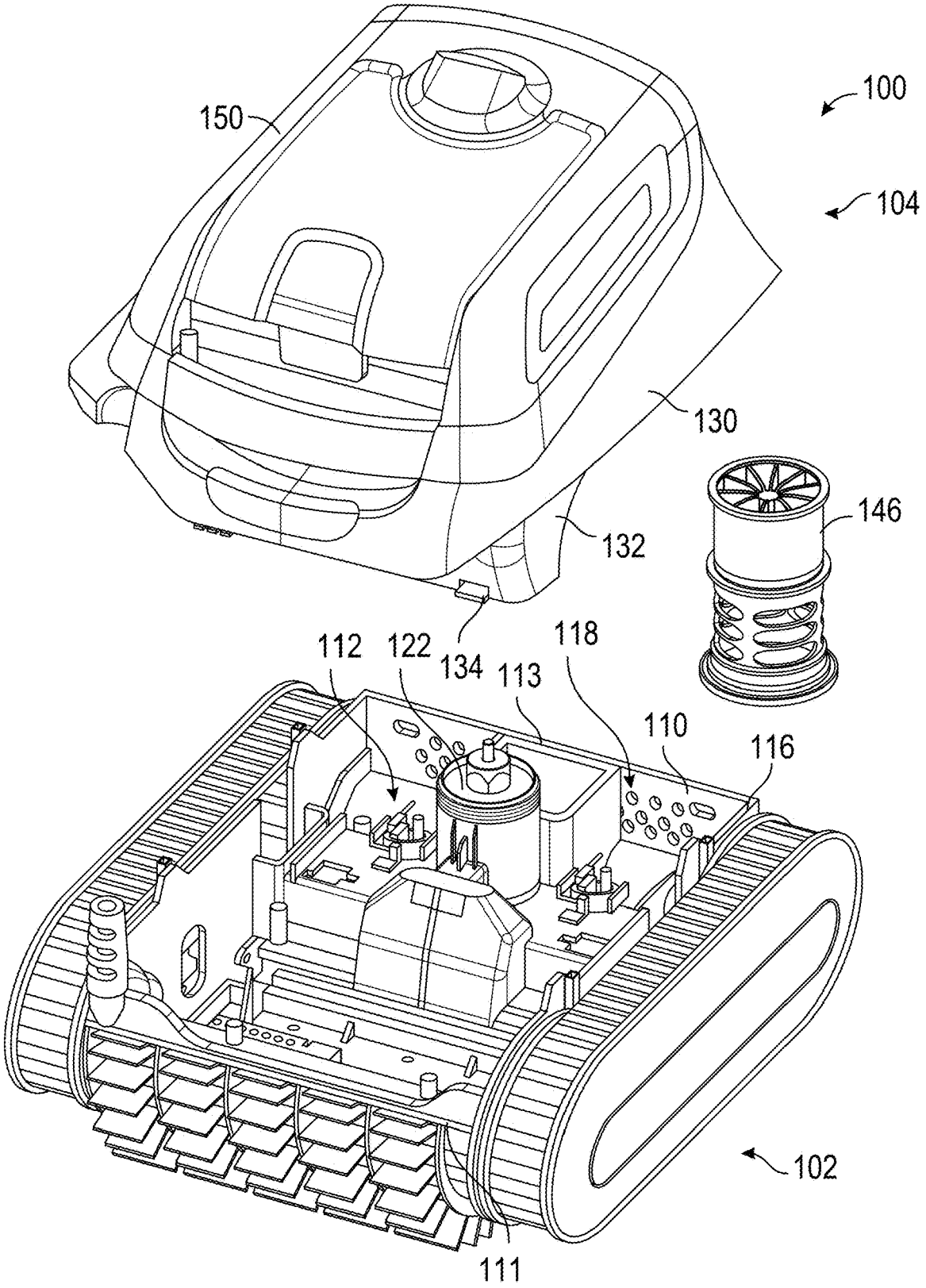
FIG. 6 is another view of the APC of FIG. 1 illustrating the body detached from the chassis.

As best illustrated in FIGS. 2-5, in various embodiments, the body 130 of the housing 104 defines a housing cavity 136 with a bottom surface 138 that is recessed relative to a top end 140 of the body 130. The particular shape and size of the housing cavity 136 should not be considered limiting. An opening 142 to the housing cavity 136 may be defined in the top end 140 of the body 130, although it need not be in the top end 140 in other embodiments. In some embodiments, and as best illustrated in FIGS. 3-5, the bottom surface 138 defines an aperture 144.

One or more components of the APC 100 may optionally be positioned at least partially within the housing cavity 136. In the embodiment illustrated, a flow outlet 146 and a debris filter (not shown) are positioned at least partially within the housing cavity 136. In this embodiment, the housing cavity 136 includes a filter-receiving area 148 that receives a debris filter when the APC 100 is assembled. As discussed in detail below, when the housing 104 is assembled with the chassis 102, a portion of the chassis 102 and/or a component positioned at least partially within the chassis 102 may optionally extend through the aperture 144 and at least partially into the housing cavity 136.

Optionally, the housing 104 includes a lid 150 that is connected to the body 130 and is movable relative to the body 130 to selectively provide or prevent access to the housing cavity 136. In certain embodiments, the lid 150 may be hingedly or pivotably attached to the body 130, although other suitable features or mechanisms may be utilized to connect the lid 150 to the body 130 and such that the lid 150 is movable relative to the body 130. In the embodiment of FIGS. 1-10 and as best illustrated in FIGS. 2-5, the lid 150 includes hinges 152 allowing it to pivot or otherwise move relative to the body 130 into an open position (see, e.g., FIG. 2) and a closed position (see, e.g., FIG. 1). In various embodiments, the lid 150 movably connected to the body 130 may allow for the housing cavity 136 to be easily accessed without disassembling the housing 104 and the chassis 102. In addition, as the housing cavity 136 often may include a removable debris filter in the filter-receiving area 148 (and/or other components such as the flow outlet 146), pivoting the lid 150 upward permits rapid removal from the housing cavity 136 and/or return of the debris filter and/or other components to the housing cavity 136. FIG. 2 illustrates the lid 150 having pivoted nominally upward from the body 130, with the debris filter typically within housing cavity 136 having been removed from the filter-receiving area 148 for emptying, repair, replacement, and/or otherwise as desired.

In certain optional embodiments, and optionally opposite from the hinges 152 (or other mechanisms enabling movement of the lid 150 relative to the body 130), the lid 150 and the body 130 may include latching mechanism 154 for selectively securing the lid 150 relative to the body 130. In certain embodiments, the latching mechanism 154 selectively secures the lid 150 in the closed position. The latching mechanism 154 may be various suitable devices or mechanisms for selectively securing the lid 150 to the body 130, and the latching mechanism 154 may be formed in any suitable manner as desired. In the embodiment of FIGS. 1-10, and with reference to FIGS. 1 and 2, the latching mechanism 154 includes a depressible button 156 that selectively engages a ledge 158 on the body 130. In this embodiment, a user may lift or depress the button 156 of the latching mechanism 154 as appropriate and rotate the lid 150 about the opposite pivot axis as shown in FIG. 2 (e.g., defined by the hinges 152) to move the lid 150 from the closed position to the open position.

Optionally, and as best illustrated in FIG. 1, the lid 150 may include a water or fluid outlet 160. In such embodiments, when the APC 100 is operational, filtered pool water may exit the outlet 160 for return to the pool. In the embodiment illustrated and with reference to FIG. 1, a single outlet 160 is included with the housing 104, and the outlet 160 is configured and oriented so as to exhaust water generally in a direction A, which optionally may be at an acute angle $\alpha$ relative to a plane parallel with a surface along which APC 100 is travelling. As illustrated in FIG. 1, such an orientation of the outlet 160 may cause the exhausted water both to propel APC 100 in a direction B (opposite from the direction A) and to provide downforce tending to increase the traction of motive elements 106 on the to-be-travelled surface. In other embodiments, the outlet 160 need not necessarily be present in the lid 150. Moreover, in yet other embodiments, more than one outlet 160 may be employed on the APC 100 as desired, the one or more outlets 160 may be at various locations on the housing 104 and/or the chassis 102 as desired, and/or the one or more outlets 160 may be at various angles relative to the plane parallel to the surface along which the APC 100 is travelling.

In certain embodiments, the flow outlet 146 is optionally included with the APC 100. The flow outlet 146 communicates with the outlet 160. In some embodiments, and as illustrated in FIG. 2, the flow outlet 146 may be at least partially positioned within the housing cavity 136 when the APC 100 is assembled. In use, the flow outlet 146 may channel filtered water to the outlet 160. In certain cases, and as described hereafter, the flow outlet 146 also may function as part of a mechanism for attaching the housing 104 and the chassis 102.

FIGS. 7A-B illustrate the flow outlet 146 in greater detail. As illustrated in FIGS. 7A-B, in some embodiments, the flow outlet 146 is generally cylindrical. However, in other embodiments, the flow outlet 146 may have other shapes or profiles as desired. In certain embodiments, the flow outlet 146 optionally may include a baffle or diffuser 162 at a first (e.g., upper) end 164 of the flow outlet 146. When the APC 100 is assembled, the first end 164 may be positioned adjacent to the outlet 160. A second (e.g., lower) end 166 of the flow outlet 146 opposite from the first end 164 may include engagement features 168 for selectively engaging a portion of the chassis 102 and/or component attached to the chassis 102, including but not limited to the motor block 122. In the embodiment illustrated, the engagement features 168 include threads, and these threads may engage corresponding threads of the engagement features 124 of the motor block 122 attached at least partially within the chassis 102. However, in other embodiments, the flow outlet 146 may be attached to the chassis 102 and/or another component attached to the chassis 102.

Referring to FIGS. 2 and 3, the flow outlet 146 may be positioned within the housing cavity 136 and may be attached to a portion of the chassis 102 and/or a component attached to the chassis 102 within the housing cavity 136. In the embodiment illustrated, the flow outlet 146 is attached to the portion of the motor block 122 extending through the aperture 144 and into the housing cavity 136. In certain optional embodiments, a diameter or corresponding greatest dimension of the second end 166 of the flow outlet 146 is greater than a diameter or greatest dimension of the aperture 144 such that the flow outlet 146 overlaps a portion of the bottom surface 138 of the housing cavity 136 adjacent to the aperture 144. In such embodiments, when the flow outlet 146 is attached to the motor block 122 (or chassis 102 and/or other component), a portion of the bottom surface 138 is retained or sandwiched between the flow outlet 146 and the one or more stoppers 126. Such an assembly may further secure the housing 104 relative to the chassis 102, in addition to or in place of the engagement features 120, 134.

In other embodiments, the flow aperture 146 need not have a diameter greater than that of the aperture 144. In such embodiments, the aperture 144 optionally may be sized and shaped to receive the flow outlet 146. In various embodiments, the aperture 144 optionally may be aligned with the flow outlet 146 when the flow outlet 146 is screwed onto motor block 122, and the flow outlet 146 may be received by the aperture 144. As noted above, when an optional lid 150 is moved to an open position, the flow outlet 146 may be unscrewed from motor block 122. In these embodiments, the entirety of the flow outlet 146 may be lifted through aperture 144 for removal. In such embodiments, the flow outlet 146 need not be connected to the motor block 122 and/or the chassis 102 within the housing cavity 136, and instead the flow outlet 146 may be connected to the motor block 122 and/or the chassis 102 within the chassis cavity 112.

Referring to FIGS. 1-6, a method of disassembling the APC 100 will be discussed below. A method of assembling the APC 100 may optionally be performed by reversing the order of steps.

In certain aspects, the method includes moving the lid 170 from the closed position (FIG. 1) to the open position (FIG. 2) and such that the flow outlet 146 is exposed. Optionally, moving the lid 170 includes engaging the button 156 of the latching mechanism 154 such that the button 156 disengages the ledge 158.

After the lid 150 is rotated to its open position as illustrated in FIG. 2, the flow outlet 146 may be accessed and unscrewed from the motor block 122 as represented by arrows C and D in FIG. 3. In certain embodiments, after the flow outlet 146 is unscrewed from the motor block 122, the housing 104 may be rotated or tilted in the direction of arrow E in FIG. 4. This rotation disengages the engagement features 134 (e.g., teeth or ribs) from the engagement features 120 (e.g., recesses or grooves), allowing the housing 104 to be completely separated from chassis 102 as illustrated in FIG. 5 and represented by arrow F. While rotation of the housing 104 is illustrated for disengaging the engagement features 120, 134, in other embodiments, the housing 104 need not be rotated to cause such disengagement. As a non-limiting example, depending on the particular mechanism or feature used as the engagement features 134, the housing 104 may be disengaged from the housing 104 by moving the housing 104 vertically (or axially) relative to the chassis 102 without rotation. In other embodiments, the housing 104 may be disengaged and separated from the chassis 102 using various other movements or techniques as desired. No tools thus need be used to separate housing 104 from chassis 102, and a new or different body could be assembled onto the chassis 102 instead if desired. Likewise, if chassis 102 or its housing cavity 136 needs to be accessed, no tools necessarily need be utilized. Moreover, a portion of the chassis 102 and/or a component attached to the chassis 102 may optionally be accessed without requiring disassembly of the housing 104 from the chassis 102 (e.g., via the aperture 144).

Figure 11:
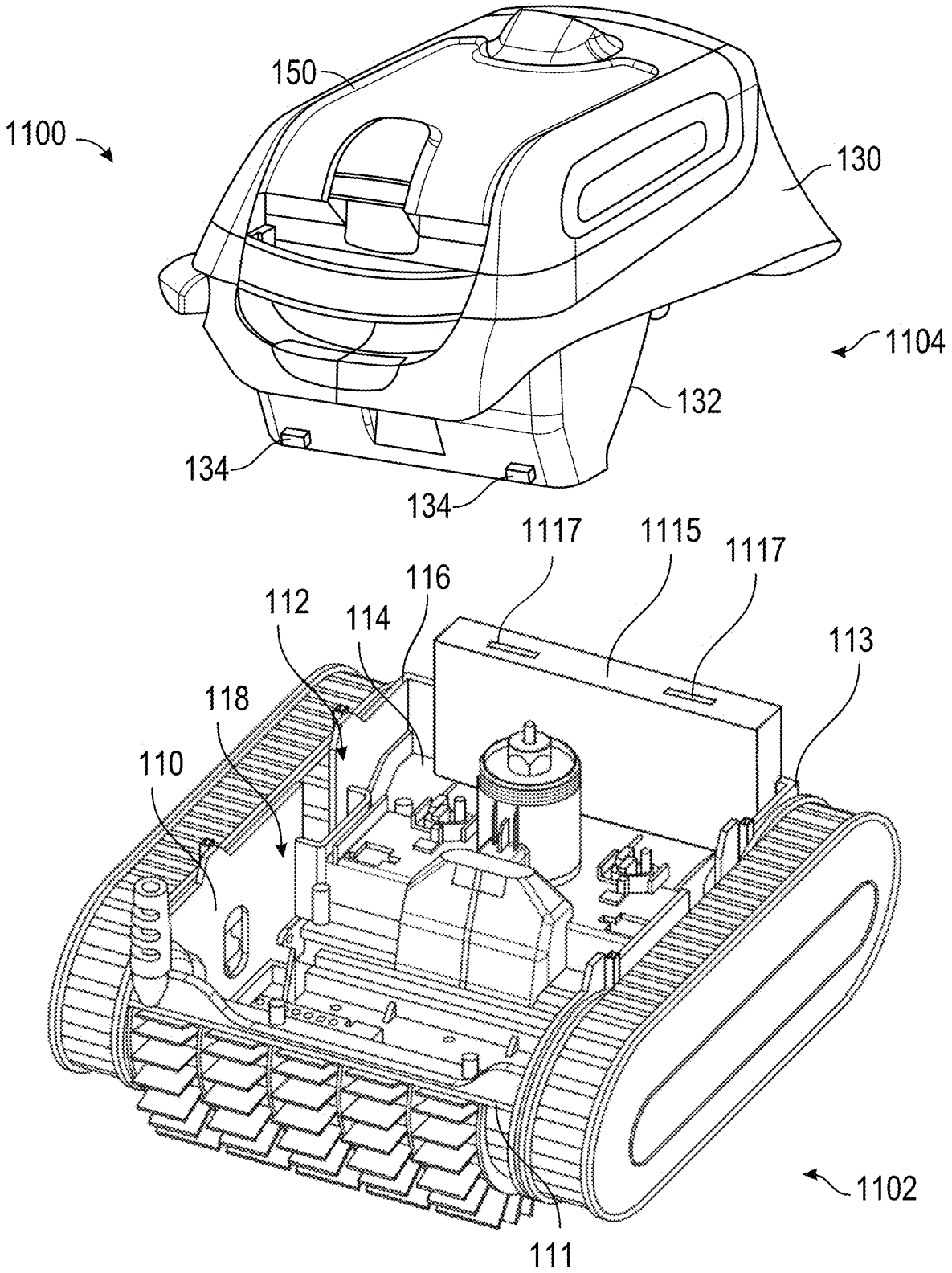
FIG. 11 illustrates another APC according to embodiments.

FIG. 11 illustrates another example of an APC 1100 with a chassis 1102 and a housing 1104. The chassis 1102 is substantially similar to the chassis 102 and the housing 1104 is substantially similar to the housing 104 except that the APC 1100 additionally includes a sub-system or a sub-assembly 1115 that is held in place when the housing 1104 of the APC 1100 is assembled with the chassis 1102. In certain embodiments, at least a portion of the sub-assembly 1115 is retained between the housing 1104 and the chassis 1102 when housing 1104 is assembled with the chassis 1102. The sub-assembly 1115 may be various sub-assemblies or sub-systems of the APC 1100 as desired, including but not limited to a battery block, an electronics housing, a filter housing, etc. Moreover, while one sub-assembly 1115 is illustrated, in other embodiments, the APC 1100 may have any number of sub-assemblies 1115 as desired. In addition, while the sub-assembly 1115 is illustrated as partially within the chassis cavity 112, in other embodiments, the sub-assembly 1115 may be entirely within the chassis cavity 112, outside or not within the chassis cavity 112, or otherwise positioned as desired. In the embodiment illustrated, the sub-assembly 1115 is a battery block of the APC 1100.

In certain embodiments, the sub-assembly 1115 optionally includes one or more engagement features 1117 that selectively engage a corresponding engagement feature on the housing 1104. In the embodiment illustrated, the engagement features 1117 are grooves that are selectively engaged by ribs or hooks on the housing 1104 (not visible in the view of FIG. 11) when the housing 1104 is assembled. However, similar to the other engagement features on other portions of the APC discussed herein, the engagement features 1117 may be various suitable devices, mechanisms, or features for selectively engaging corresponding features on the housing 1104. When the APC 1100 is assembled, the housing 1104 may engage both the chassis 1102 and the sub-assembly 1115 such that the housing 1104 and sub-assembly 1115 are held in place relative to the chassis 1102. As such, in addition to providing assembly and disassembly of the housing 1104 with the chassis 1102 without requiring tools, the assemblies described herein also allow for assembly and disassembly of sub-systems of the APC 1100 without requiring tools.

The invention thus provides robust assemblies of autonomous vehicles such as APCs and permits components of the APCs to be assembled and disassembled without tools when desired. As long as a body contains connecting mechanisms complementary to those of the chassis, customization of the APCs may occur by providing different bodies on the same chassis (or vice-versa). Utilizing a common chassis, in particular, may also reduce times needed for production and maintenance of the APCs.

A collection of exemplary embodiments are provided below, including at least some explicitly enumerated as "Illustrations" providing additional description of a variety of example embodiments in accordance with the concepts described herein. These illustrations are not meant to be mutually exclusive, exhaustive, or restrictive; and the disclosure not limited to these example illustrations but rather encompasses all possible modifications and variations within the scope of the issued claims and their equivalents.

Illustration 1. An automatic swimming pool cleaner comprising a chassis and a body configured to detach from the chassis without using tools.

Illustration 2. An automatic swimming pool cleaner comprising a common chassis and interchangeable bodies configured for attachment to, and detachment from, the common chassis.

Illustration 3. An automatic swimming pool cleaner comprising a chassis, a motor assembly having at least a portion contained in the chassis, and a body configured for attachment to the chassis, with the body comprising a lid movable between (i) a closed position and (ii) an open position providing access to the motor assembly Illustration 4. An automatic swimming pool cleaner comprising a chassis and a body, one of the chassis or body containing teeth and the other containing recesses for receiving the teeth.

Illustration 5. An automatic swimming pool cleaner comprising a chassis, a body, a motor block positioned at least partially in the chassis, and a flow outlet configured to attach to the motor block in a manner sandwiching the body between them.

Illustration 6. A method of disassembling an automatic swimming pool cleaner having a chassis, a body, and a flow outlet, comprising: (i) opening a lid of the body to expose the flow outlet, (ii) detaching the flow outlet from a motor assembly, and (iii) rotating the body so as to disengage the body from the chassis.

Illustration 7. An automatic swimming pool cleaner comprising a housing and a chassis, wherein the housing is removably attached to the chassis.

Illustration 8. The automatic swimming pool cleaner of any preceding or subsequent illustration or combination of illustrations, wherein the chassis comprises a chassis cavity, wherein the housing comprises a body and an engagement section extending downwardly from the body, and wherein the engagement section of the housing is positionable within the chassis cavity such that the housing is removably attached to the chassis.

Illustration 9. The automatic swimming pool cleaner of any preceding or subsequent illustration or combination of illustrations, wherein the chassis further comprises a first engagement feature within the chassis cavity, wherein the housing comprises a second engagement feature on the engagement section that is complimentary to the first engagement feature, and wherein the engagement section of the housing is positionable within the chassis cavity such that the first engagement feature selectively engages the second engagement feature.

Illustration 10. The automatic swimming pool cleaner of any preceding or subsequent illustration or combination of illustrations, wherein one of the first engagement feature or the second engagement feature comprises a recess or a first rib, and wherein the other one of the first engagement feature or the second engagement feature comprises a second rib.

Illustration 11. The automatic swimming pool cleaner of any preceding or subsequent illustration or combination of illustrations, wherein the chassis comprises a chassis cavity, wherein the housing comprises a housing cavity, and wherein the automatic swimming pool cleaner further comprises a motor block positioned at least partially within the chassis cavity and extending at least partially into the housing cavity.

Illustration 12. The automatic swimming pool cleaner of any preceding or subsequent illustration or combination of illustrations, wherein the housing cavity comprises a bottom surface recessed relative to a top end of the housing, wherein the bottom surface defines an aperture, and wherein the motor block extends at least partially through the aperture and into the housing cavity.

Illustration 13. The automatic swimming pool cleaner of any preceding or subsequent illustration or combination of illustrations, further comprising: a motor block positioned at least partially in the chassis; and a flow outlet configured to attach to the motor block such that at least a portion of the housing is retained between the motor block and the flow outlet.

Illustration 14. An automatic swimming pool cleaner comprising: a chassis; a housing; a motor block positioned at least partially in the chassis; and a flow outlet configured to removably attach to the motor block such that at least a portion of the housing is retained between the motor block and the flow outlet.

Illustration 15. The automatic swimming pool cleaner of any preceding or subsequent illustration or combination of illustrations, wherein the housing comprises a housing cavity, wherein the motor block extends at least partially into the housing cavity, and wherein the flow outlet is within the housing cavity.

Illustration 16. The automatic swimming pool cleaner of any preceding or subsequent illustration or combination of illustrations, wherein the motor block comprises an engagement portion and at least one stopper, and wherein the flow outlet is configured to attach to the engagement portion of the motor block such that the portion of the housing is retained between the flow outlet and the at least one stopper.

Illustration 17. The automatic swimming pool cleaner of any preceding or subsequent illustration or combination of illustrations, wherein the housing comprises a housing cavity with a bottom surface that is recessed relative to a top end of the housing, and wherein the flow outlet is configured to attach to the motor block such that a portion of the bottom surface of the housing cavity is retained between the motor block and the flow outlet.

Illustration 18. The automatic swimming pool cleaner of any preceding or subsequent illustration or combination of illustrations, wherein the housing comprises a body and an engagement section extending downwardly from the body, and wherein the engagement section of the housing is positionable within the chassis such that the housing is removably attached to the chassis.

Illustration 19. The automatic swimming pool cleaner of any preceding or subsequent illustration or combination of illustrations, wherein the chassis comprises a chassis cavity, wherein the motor block is positioned at least partially within the chassis cavity and the engagement section of the housing is positioned at least partially within the chassis cavity, wherein the chassis further comprises a first engagement feature within the chassis cavity, wherein the housing comprises a second engagement feature on the engagement section that is complimentary to the first engagement feature, and wherein the engagement section of the housing is positionable within the chassis cavity such that the first engagement feature selectively engages the second engagement feature.

Illustration 20. An automatic swimming pool cleaner comprising: a chassis comprising a chassis cavity, a housing comprising a housing cavity; and a motor assembly positioned at least partially in the chassis cavity and extending at least partially into the housing cavity.

Illustration 21. The automatic swimming pool cleaner of any preceding or subsequent illustration or combination of illustrations, wherein the housing further comprises a lid movable between a closed position and an open position relative to the housing cavity, wherein the lid in the open position provides access to the motor assembly at least partially in the housing cavity.

Illustration 22. The automatic swimming pool cleaner of any preceding or subsequent illustration or combination of illustrations, wherein the housing cavity comprises a bottom surface that is recessed relative to a top end of the housing, wherein the bottom surface defines an aperture, and wherein the motor assembly extends at least partially through the aperture and into the housing cavity.

Illustration 23. The automatic swimming pool cleaner of any preceding or subsequent illustration or combination of illustrations, further comprising a flow outlet that is configured to attach to the motor assembly within the housing cavity such that at least a portion of the bottom surface of the housing cavity is retained between the motor assembly and the flow outlet.

Illustration 24. The automatic swimming pool cleaner of any preceding or subsequent illustration or combination of illustrations, further comprising a flow outlet within the housing cavity and configured to attach to the motor assembly such that at least a portion of the housing is retained between the motor assembly and the flow outlet.

Illustration 25. The automatic swimming pool cleaner of any preceding or subsequent illustration or combination of illustrations, wherein the housing further comprises a body and an engagement section extending downwardly from the body, wherein the body defines the housing cavity, and wherein the engagement section of the housing is positionable within the chassis cavity such that the housing is removably attached to the chassis.

Illustration 26. The automatic swimming pool cleaner of any preceding or subsequent illustration or combination of illustrations, wherein the chassis further comprises a first engagement feature within the chassis cavity, wherein the housing comprises a second engagement feature on the engagement section that is complimentary to the first engagement feature, and wherein the engagement section of the housing is positionable within the chassis cavity such that the first engagement feature selectively engages the second engagement feature.

Illustration 27. An automatic swimming pool cleaner comprising a housing, a chassis, and a sub-assembly, wherein the housing is removably attached to the chassis, and wherein attachment of the housing to the chassis holds the sub-assembly on the chassis.

Illustration 28. The automatic swimming pool cleaner of any preceding or subsequent illustration or combination of illustrations, wherein the sub-assembly comprises a battery block.

Illustration 29. The automatic swimming pool cleaner of any preceding or subsequent illustration or combination of illustrations, wherein the housing is removably attached to the sub-assembly.

Illustration 30. The automatic swimming pool cleaner of any preceding or subsequent illustration or combination of illustrations, wherein the sub-assembly is positioned at least partially within the chassis.

Illustration 31. The automatic swimming pool cleaner of any preceding or subsequent illustration or combination of illustrations, wherein at least a portion of the sub-assembly is retained between the housing and the chassis.

Illustration 32. An automatic swimming pool cleaner comprising a housing, a chassis, and a sub-assembly, wherein the housing is removably attached to the chassis and is removably attached to the sub-assembly.

The above-described aspects are merely possible examples of implementations, merely set forth for a clear understanding of the principles of the present disclosure. Many variations and modifications can be made to the above-described example(s) without departing substantially from the spirit and principles of the present disclosure. All such modifications and variations are included herein within the scope of the present disclosure, and all possible claims to individual aspects or combinations of elements or steps are intended to be supported by the present disclosure. For avoidance of doubt, any combination of features not physically impossible or expressly identified as non-combinable herein may be within the scope of the invention. Further, although applicant has described devices and techniques for use principally with APCs, persons skilled in the relevant filed will recognize that the present invention conceivably could be employed in connection with other objects and in other manners. Moreover, although specific terms are employed herein, as well as in the claims that follow, they are used only in a generic and descriptive sense, and not for the purposes of limiting the described invention, nor the claims that follow.

That which is claimed is:

1. An automatic swimming pool cleaner comprising: a chassis; a housing; a motor block positioned at least partially in the chassis; and a flow outlet attachable to and removable from the motor block, wherein, when the flow outlet is attached to the motor block, at least a portion of the housing is retained between the motor block and the flow outlet; and wherein the flow outlet is removable from the automatic swimming pool cleaner.

2. The automatic swimming pool cleaner of claim 1, wherein the housing comprises a housing cavity, wherein the motor block extends at least partially into the housing cavity, and wherein the flow outlet is within the housing cavity.

3. The automatic swimming pool cleaner of claim 1, wherein the motor block comprises an engagement portion and at least one stopper, and wherein the flow outlet is configured to attach to the engagement portion of the motor block such that the portion of the housing is retained between the flow outlet and the at least one stopper.

4. The automatic swimming pool cleaner of claim 1, wherein the housing comprises a housing cavity with a bottom surface that is recessed relative to a top end of the housing, and wherein the flow outlet is configured to attach to the motor block such that a portion of the bottom surface of the housing cavity is retained between the motor block and the flow outlet.

5. The automatic swimming pool cleaner of claim 1, wherein the housing comprises a body and an engagement section extending downwardly from the body, and wherein the engagement section of the housing is positionable within the chassis such that the housing is removably attached to the chassis.

6. The automatic swimming pool cleaner of claim 5, wherein the chassis comprises a chassis cavity, wherein the motor block is positioned at least partially within the chassis cavity and the engagement section of the housing is positioned at least partially within the chassis cavity, wherein the chassis further comprises a first engagement feature within the chassis cavity, wherein the housing comprises a second engagement feature on the engagement section that is complimentary to the first engagement feature, and wherein the engagement section of the housing is positionable within the chassis cavity such that the first engagement feature selectively engages the second engagement feature.

7. An automatic swimming pool cleaner comprising:

a chassis comprising a chassis cavity;

a housing comprising a housing cavity, wherein the housing cavity comprises a floor separating the housing cavity from the chassis cavity; and a motor assembly positioned at least partially in the chassis cavity and extending at least partially into the housing cavity through the floor of the housing cavity, wherein the housing further comprises a body and an engagement section extending downwardly from the body, wherein the body defines the housing cavity, and wherein the engagement section of the housing is positionable within the chassis cavity such that the housing is removably attached to the chassis.

8. The automatic swimming pool cleaner of claim 7, wherein the housing further comprises a lid movable between a closed position and an open position relative to the housing cavity, wherein the lid in the open position provides access to the motor assembly at least partially in the housing cavity.

9. The automatic swimming pool cleaner of claim 7, wherein the housing cavity comprises a bottom surface that is recessed relative to a top end of the housing, wherein the bottom surface defines an aperture, and wherein the motor assembly extends at least partially through the aperture and into the housing cavity.

10. The automatic swimming pool cleaner of claim 9, further comprising a flow outlet that is configured to attach to the motor assembly within the housing cavity such that at least a portion of the bottom surface of the housing cavity is retained between the motor assembly and the flow outlet.

11. The automatic swimming pool cleaner of claim 7, further comprising a flow outlet within the housing cavity and configured to attach to the motor assembly such that at least a portion of the housing is retained between the motor assembly and the flow outlet.

12. The automatic swimming pool cleaner of claim 7, wherein the chassis further comprises a first engagement feature within the chassis cavity, wherein the housing comprises a second engagement feature on the engagement section that is complimentary to the first engagement feature, and wherein the engagement section of the housing is positionable within the chassis cavity such that the first engagement feature selectively engages the second engagement feature.

* * * * *